US005218833A

United States Patent [19]

Newbold

[11] Patent Number: 5,218,833

[45] Date of Patent: Jun. 15, 1993

[54] TEMPERATURE AND HUMIDITY CONTROL IN A CLOSED CHAMBER

[75] Inventor: David D. Newbold, Bend, Oreg.

[73] Assignee: Bend Research, Inc., Bend, Oreg.

[21] Appl. No.: 850,384

[22] Filed: Mar. 11, 1992

[51] Int. Cl.[5] ..... F25D 17/08

[52] U.S. Cl. ..... 62/92; 62/314; 261/104; 261/151; 261/DIG. 27

[58] Field of Search ..... 62/92, 314; 261/DIG. 27, 104, 107, 151; 34/75

[56] References Cited

U.S. PATENT DOCUMENTS

| | | | |
|---|---|---|---|
| 1,673,732 | 6/1928 | Brooks | 261/DIG. 27 |
| 2,062,771 | 12/1936 | Stead | 62/92 |
| 2,332,975 | 10/1943 | Palmer | 62/92 X |
| 3,808,832 | 5/1974 | Zusmanovich | 62/314 X |
| 3,854,909 | 12/1974 | Hoisington et al. | 261/151 X |
| 3,890,797 | 6/1975 | Brown | 62/92 X |
| 4,259,268 | 3/1981 | DeRoss | 261/151 |
| 4,538,426 | 9/1985 | Bock | 261/151 X |

*Primary Examiner*—William E. Tapolcai

*Attorney, Agent, or Firm*—Chernoff, Vilhauer, McClung & Stenzel

[57] ABSTRACT

A process is disclosed for maintaining the temperature and humidity of a closed chamber within preferred ranges when contributions in water vapor and energy additions to the chamber from plants and humans vary over time. Enough water is evaporated into the air of the chamber such that when added to the water vapor added by transpiration a constant maximum rate of water vapor addition is maintained, thereby increasing air humidity and decreasing air temperature. A portion of warm moist air from the chamber is circulated to a water recovery heat exchanger module to remove additional sensible heat and to recover the amount of water evaporated in the chamber; cool dry air is returned to the chamber.

20 Claims, 4 Drawing Sheets

TEMPERATURE AND HUMIDITY CONTROL IN A CLOSED CHAMBER

The government has a nonexclusive, nontransferable, royalty-free license to practice this invention under Contract No. NAS 2-13345 awarded by the National Aeronautics and Space Administration.

BACKGROUND OF THE INVENTION

In the confined spaces of manned spacecraft that have variable energy and water vapor input from plants and humans, there is a need to regulate temperature and humidity so as to minimize variations of the same. These needs and others are met by the present invention, which is summarized and described in detail below.

SUMMARY OF THE INVENTION

The present invention is a method of controlling the temperature and humidity in a closed chamber having a variable energy and water vapor input comprising the steps: (a) circulating an air stream in the closed chamber; (b) humidifying the air stream by evaporating water into the same, thereby creating a humidified air stream; (c) removing at least a portion of the humidified air stream from the closed chamber; (d) condensing water vapor in the humidified air stream by directing the same to a condenser, thereby removing sensible and latent heat from the humidified air stream to create a water vapor condensate and a cooled and dehumidified air stream; and (e) returning at least a portion of the cooled and dehumidified air stream to the closed chamber.

The foregoing and other objectives, features, and advantages of the invention will be more readily understood upon consideration of the following detailed description of the invention, taken in conjunction with the accompanying drawings.

DETAILED DESCRIPTION OF THE INVENTION

According to the present invention there is provided a simple, energy-efficient process for maintaining the temperature and humidity of a closed chamber within preferred ranges when contributions in water vapor and energy additions to the chamber from both humans and growing plants are variable over time. The process is suitable for use in any closed chamber sustaining both plant and human life but is especially suitable for use in micro-gravity environments or in confined spaces such as those found in manned spacecraft.

The essence of the invention lies in evaporating water into the air of the chamber, thereby increasing the humidity and decreasing the temperature of the air in the chamber, while converting sensible heat to latent heat. Enough water is added to the chamber by evaporation so that the total rate of water addition from the combined addition from plant transpiration and evaporation will equal the desired rate of water addition. This total rate of water addition is that rate which provides the desired humidity level in the chamber. The maximum total rate of water addition can be selected to equal the maximum expected plant transpiration rate.

Energy input to the chamber includes the energy added by the growth lights for the plants. Much of this energy is converted to sensible heat which must be removed from the chamber to prevent an undesired temperature rise. Adjusting the rate of water evaporation controls the amount of sensible heat converted to latent heat and contributes to the temperature control in the chamber.

Continued control of the temperature and humidity of the closed chamber by water vapor addition from some combination of plant transpiration and evaporation is made possible by removing from the chamber a portion of the warm, moist air, cooling and dehumidifying that portion of warm, moist air, and returning to the chamber at least some portion of the resultant cool, dry air. By removing this additional sensible heat the temperature in the chamber can be maintained within the desired range by adjusting the rate of water added to the chamber by evaporation.

Figure 1:
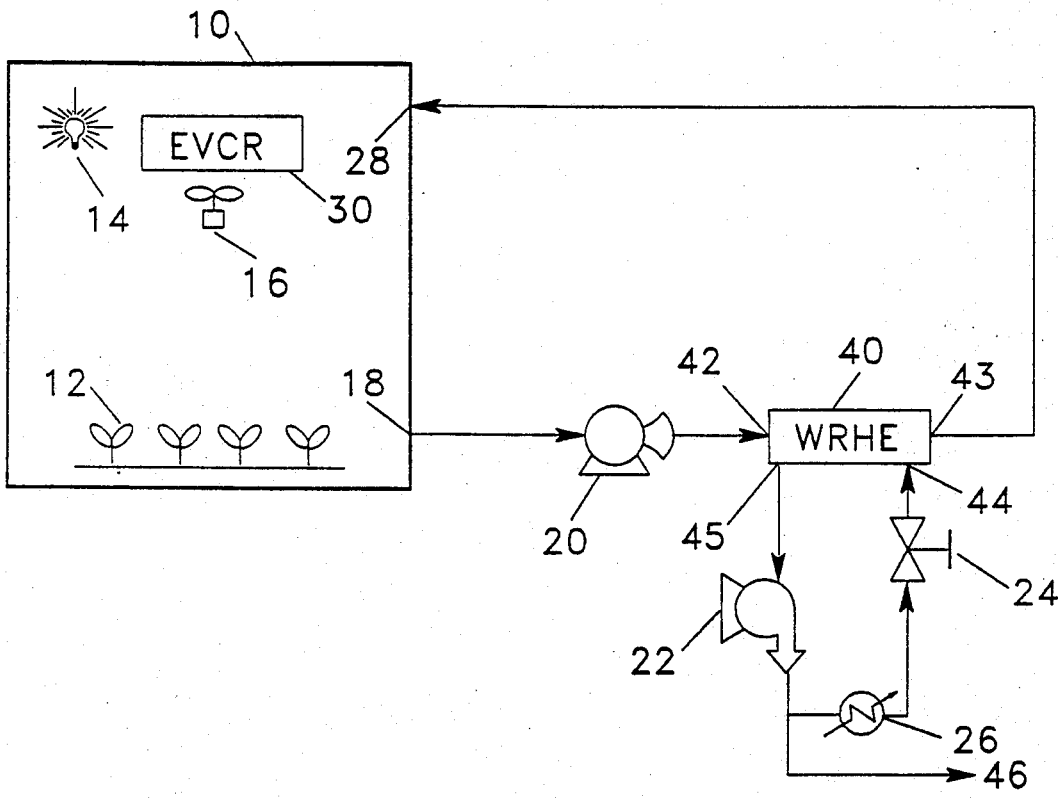
FIGS. 1-2 are schematics illustrating exemplary embodiments of the invention.

The process of the present invention is illustrated in the schematic drawings, wherein like numerals refer to the same elements. In FIG. 1 there is shown a closed chamber 10 containing live plants 12 and a growth lamp 14 for the plants. The lamp 14 is a source of radiant heat and more than a single lamp may be required to support the desired plant growth. The plants 12 contribute to the relative humidity of their environment by the process of transpiration, and the rate of transpiration depends, among other things, on the stage of development of the plants. For example, seedlings will transpire little, while fully mature plants would transpire at some maximum rate under ideal conditions.

The chamber also contains a source of liquid water available for evaporation. In a preferred embodiment of the invention, this source of water is a membrane-based evaporative cooler 30 ("EVCR"), which will be discussed in more detail below. At any given air temperature, as long as the air is not saturated with water vapor, that is, where the relative humidity is less than 100%, water will evaporate into the air. Any supply of water could therefore serve as the source of liquid water. However, in the confines of a spacecraft under microgravity conditions, many sources, such as a simple pan of water, would be unsatisfactory due to problems associated with confining the liquid water within its container as it evaporates.

Air in the chamber is moved past the EVCR by blower 16, allowing the water in the evaporative cooler to evaporate into the moving air stream. Represented schematically in FIG. 1, the motor-driven blower 16 has at least an on-off function, and preferably has a variable-speed control, for controlling the rate at which air is moved past the EVCR, and thereby also controlling the rate of evaporation of water into the air of the chamber. Thus, the humidity in the chamber may be controlled by adjusting the blower 16 input to the EVCR 30. The feed air flow rate to the EVCR determines the amount of sensible heat converted into latent heat.

At least a portion of the air of the chamber is circulated through an external heat exchanger and a condenser, or other means for removing water vapor from the air. Any method of removing sensible heat, latent heat, and water vapor from air is acceptable for use with the invention. In a preferred embodiment a membrane-based water recovery heat exchanger 40

("WRHE") is used. Feed air for the WRHE is removed from the chamber at outlet port 18. A blower 20 directs the warm, moist air from the chamber against one side, the feed side, of a hollow fiber hydrophilic membrane of the WRHE through an air inlet port 42. Water is pumped by water pump 22 into contact with the second side, the permeate side, of the hydrophilic membrane at a water inlet port 44, the water first passing through throttle valve 24 and water chiller 26.

The permeate side chilled water serves as a heat sink for the removal of sensible and latent heat from the feed side warm air. After passing through the throttle valve, the permeate side chilled water is at a reduced pressure relative to the feed side air. As the sensible heat is removed from the warm moist feed side air to the cool permeate side water, the temperature of the feed side air decreases. When the temperature of the air reaches the dewpoint water begins to condense from the air, thereby removing moisture and latent heat from the air stream. The reduced pressure on the permeate side of the hydrophilic membrane provides the driving force for transport of the condensed water vapor across the hollow fiber wall where it is entrained in the chilled water together with its latent heat.

This recovered liquid water exits the WRHE at the water outlet port 45 and can be recovered, for example, at the outlet 46 of the water pump 22 and reused as desired. Cool, dry air exits the module at the air outlet port 43 and all or a portion of the air is returned to the chamber at the chamber inlet port 28.

The dry-bulb temperature at the outlet port 18 of the chamber illustrated in FIG. 1 will be higher than the dry-bulb temperature at the inlet port 28 of the chamber. As air passes through the chamber, there will be a rise in its temperature because the amount of sensible heat converted to latent heat through transpiration and the evaporation of water in the membrane-based evaporative cooler is less than the total heat energy input into the chamber.

Figure 2:
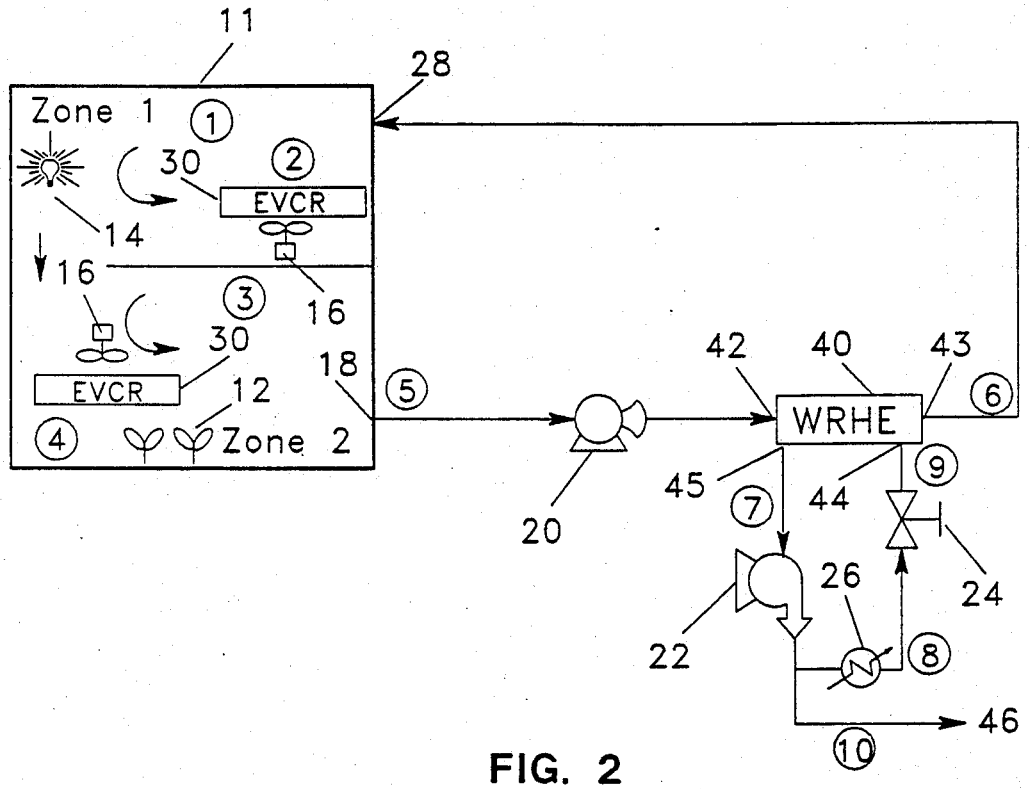

In FIG. 2, a chamber 11 containing two plant zones is illustrated. Although plants 12 are illustrated as being present only in a single zone of the chamber 11 shown in FIG. 2, each zone may contain growing plants if desired, and because of the temperature rise in the air as it passes through the chamber, different species of plants preferring different temperatures may be advantageously grown in the different zones.

Each zone of chamber 11 contains a EVCR 30 and motor-driven blower 16 capable of directing a flow of air past the EVCR to control the rate of evaporation of water into the air in each zone of the chamber. Air transits the chamber to the outlet port 18, where a portion of the air is removed. A blower 20 directs this portion of the air into the air inlet port 42 of the WRHE module 40 where water vapor, and sensible and latent heat are removed as discussed above.

It is a desirable feature of the invention that the load on the water recovery heat exchanger module remains constant for simplicity and ease of operation. Therefore, in a preferred embodiment of the invention the total amount of water removed by the WRHE module is equal to the total amount of water added to the chamber by plant transpiration and through evaporation by the evaporative cooler module or modules.

Figure 3A:
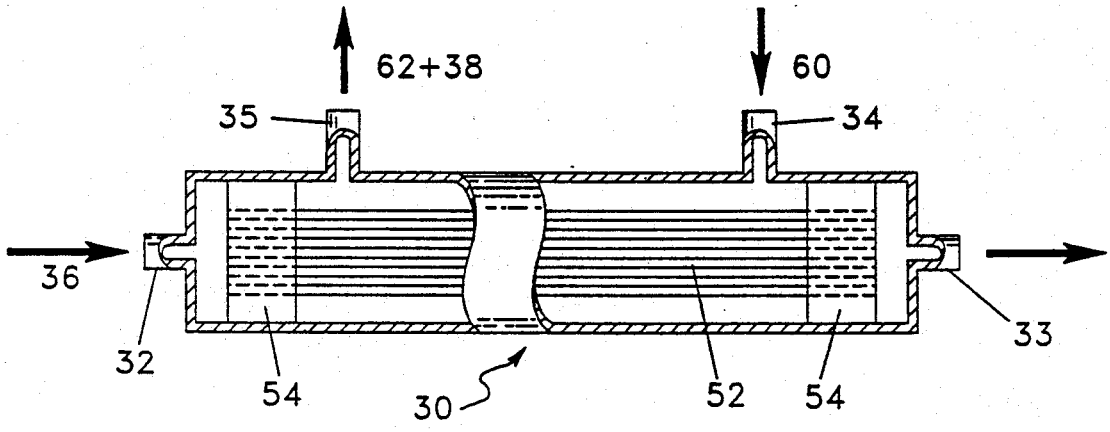
FIGS. 3*a*, 3*b*, 4*a* and 4*b* of exemplary membrane-based evaporative coolers and water recovery heat exchangers, respectively.
Figure 3B:
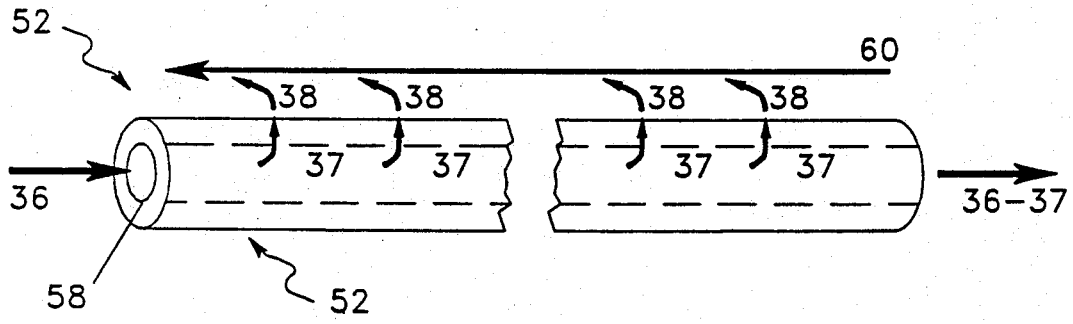

A membrane-based EVCR module 30 is illustrated in FIGS. 3*a* and 3*b*. In FIG. 3*a* there is shown a module 30 having a water inlet port 32, a water outlet port 33, an air inlet port 34 and an air outlet port 35. The module contains a multiplicity of hollow fibers 52, the ends of which are secured in mating relationship to the ends of the module by potting compound 54. Water 36 is conducted into inlet port 32 and thence through the lumens 58 of the hollow fibers 52. Warm air 60 is fed into inlet port 34 so as to be in contact with the outside, or "shell" side, of the hollow fibers 52. Cool air 62 and evaporated water vapor 38 exit the module at air outlet port 35.

In FIG. 3*b*, which is a schematic of the evaporation process in a single hollow fiber of the EVCR, water feed 36 is shown entering the lumen 58 of fiber 52, while warm air 60 is shown flowing countercurrently on the outside of the fiber. Water 37 from water feed 36 is shown being drawn into the hollow fiber membrane wall, permeating therethrough and evaporating as water vapor 38 into the air 60.

The membrane for the EVCR may be hydrophilic or microporous hydrophobic, preferably the latter. Particularly preferred hydrophobic membranes are those with pore sizes preferably $\leqq 0.1$ micron in diameter of polypropylene, polysulfone, and polyvinylidine fluoride.

Particularly preferred hydrophilic membranes for the EVCR are those of cellulose acetate, regenerated cellulose and polyacrylonitrile. Hydrophilic membranes may be "nonporous," (i.e., having a dense "skin" on one side of the membrane) or microporous, with pores $\leqq 0.1$ micron in diameter. The walls of the hydrophilic hollow fiber membrane preferably have a thickness of 5–100 microns and an inside diameter or lumen of at least 50 microns.

Although water may be circulated through the EVCR, this is not necessary. Indeed, the water outlet port 33 may be closed during operation. In this case, the flow of water into the EVCR is the same at which water is evaporated from the fibers.

The pressure drop of air fed through the module should be low to minimize energy consumption. Preferably, the pressure drop should be less than 1 psia.

Although a countercurrent mode of operation is depicted in FIG. 3*b*, both crossflow and coflow will also work in the evaporative process of the present invention.

Figure 4A:
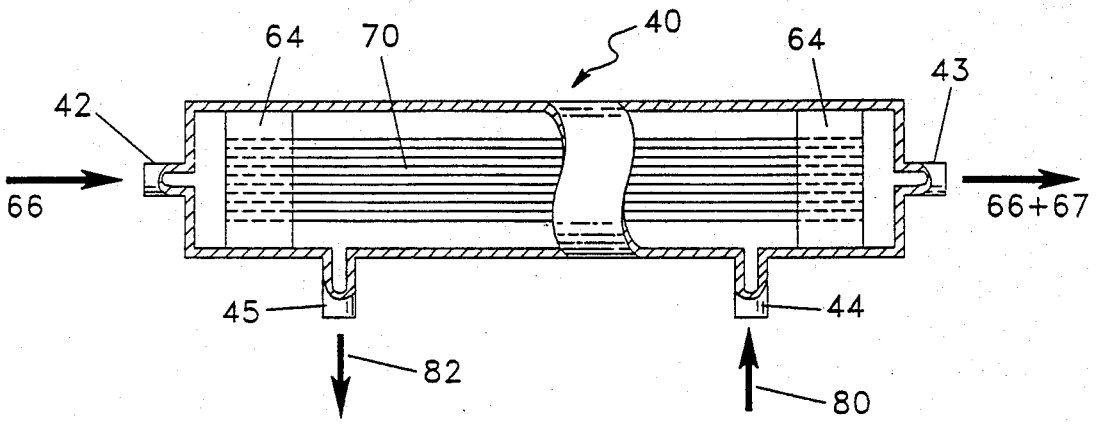
Figure 4B:
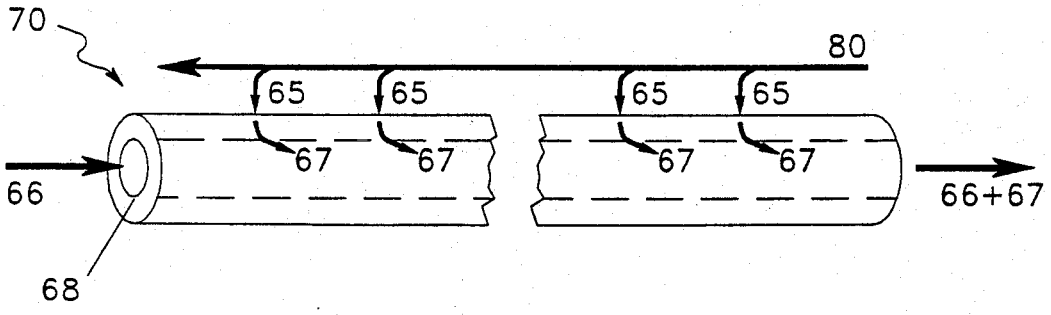

A WRHE module 40 is illustrated in FIGS. 4*a* and 4*b*. In FIG. 4*a* there is shown a module 40 having a cool water inlet port 42, a warm, moist air inlet port 44, a cool, dry air outlet port 45 and a retentate or combined cool water/water vapor condensate outlet port 43. The module 40 contains a multiplicity of hydrophilic hollow fibers 70, the ends of which are secured in mating relationship to the two ends of the module by potting compound 64. Cool water 66 is conducted into the inlet port 42 and thence through the lumens 68 of the hollow fibers 70. Warm, moist air 80 is fed into inlet port 44 so as to be in contact with the outside, or feed side, of the hollow fibers 70. Cool water and entrained water vapor condensate 67 exit the module via outlet port 43, while cool, dry air 82 exits via outlet port 45.

In FIG. 4*b*, which is a schematic of the process in a single hollow fiber of the WRHE, cool water 66 is shown entering the lumen 68 of fiber 70, while warm, moist air 80 is shown flowing countercurrently on the outside of the fiber. Water vapor 65 from the warm, moist air 80 is shown condensing on the hollow fiber membrane wall and permeating therethrough as water vapor condensate 67 which is entrained in the cool water stream 66.

The hydrophilic membrane is preferably either nonporous or microporous, with pores ≦0.1 micron in diameter. Particularly preferred membranes are those of cellulose acetate, regenerated cellulose and polyacrylonitrile. The walls of the hollow fiber membranes preferably have a thickness of 5–100 microns and an inside diameter or lumen of at least 50 microns.

Both crossflow and coflow modes of operation will also work for the water recovery heat exchanger module as well as the countercurrent flow shown in FIG. 4.

The pressure differential between the feed and permeate sides of the hydrophilic hollow fiber membrane should be in a range of 0.0007 to 1 atm (0.01 to 15 psi), preferably 0.007 to 0.5 atm (0.1 to 8 psi). Pressure of the cooling water on the permeate side of the membrane is preferably 0.01–0.99 atm. (0.15–14.6 psia), and pressure drop along the length of a hollow fiber membrane should not exceed 10 psi. Pressure drop of the water feed through the module should not exceed 0.03 atm (0.4 psi), while the feed rate should be 0.01–0.5 $m^3/m^2$·min.

The temperature differential between the dewpoint of the warm moist air feed and the cool water condensation/entrainment fluid is preferably at least 1° C.

By way of illustration of the features of the invention a theoretical packet of air can be followed through the system. With reference to FIG. 2, the desired temperature in zone 1 is set at 24° C., with the maximum desired temperature throughout the chamber at 25° C. It is to be understood that some other zone 1 temperature and maximum temperature could be selected based on various considerations including the particular plant varieties being grown and the comfort level of any humans present. In this example, the primary energy input to the chamber is from required growth lights. In FIG. 2, the circled numerals represent various state points in the system. Table I sets forth the conditions at these state points, assuming operation at the flowrates and with the specifications recited n the Table.

TABLE 1

| State Point | Temperature Dry Bulb (°C.) | Temperature Dewpoint (°C.) | Relative Humidity (%) | Flow Rates Air (L/min) | Flow Rates Water (ml/min) |
|---|---|---|---|---|---|
| 1 | 24 | 16 | 61 | — | |
| 2 | 22 | 18 | 79 | 970 | |
| 3 | 25 | 19 | 69 | — | |
| 4 | 23 | 20 | 84 | 1700 | |
| 5 | 25 | 19 | 69 | 550 | |
| 6 | 14 | 14 | 100 | 550 | |
| 7 | 7 | — | — | — | 1400 |
| 8 | 5 | — | — | — | 1397 |
| 9 | 5 | — | — | — | 1397 |
| 10 | 7 | — | — | — | 2.6 |

System Specifications
200 watts from lights
1 $m^2$ growing area
2.6 ml/min recovered water
1.3 ml/min water evaporated by EVCR #1
1.3 ml/min water evaporated by EVCR #2
0.005 atm pressure drop through WRHE module
0.003 atm pressure drop through EVCR module
12 watts for WRHE blower
28 watts for EVCR blowers
40 watts total for blowers Beginning with the theoretical packet of air in zone 1, at state point 1, the conditions in zone 1 correspond to the desired conditions for that zone. Zone 1 and the air in it have a dry-bulb temperature of 24° C. and a dewpoint of 16° C. As the air transits zone 1, control of the temperature rise across the zone is maintained by directing a stream of air through the EVCR in zone 1. Water evaporates into this stream of air, at state point 2, lowering the air streams's dry-bulb temperature to 22° C. and raising its dewpoint temperature to 18° C. This stream of air is then mixed by convection with the remainder of the air circulating in the chamber zone 1 to maintain the desired temperature and humidity level.

As a result of the energy input to the chamber, due mainly to the growth lights, the temperature in zone 2 is 25° C., and the dewpoint is 19° C., as represented by state point 3. The temperature rise of the air as it transits zone 2 is kept low in part by the transpiration of plants. To complete the control of the temperature rise across the zone, a stream of air from zone 2 is directed through the second EVCR in zone 2. Water is evaporated into the stream of air in zone 2 lowering the air stream's dry-bulb temperature to 23° C. with a dewpoint temperature of 20° C. at state point 4. Again this stream of air is mixed with the remainder of the air in the chamber so that when a portion of the air is removed from the chamber at the outlet port 18, at state point 5, that portion of the air has the desired dry-bulb temperature of 25° C. and a dewpoint of 19° C. Enough water is evaporated into the chamber from the two EVCR's to keep the total amount of water vapor input to the chamber constant, regardless of the rate of transpiration by the plants.

The portion of air removed from the chamber at state point 5 is directed through the WRHE module 40. Water vapor is removed from the portion of air and transported across the hollow fibers of the WRHE. The total amount of water removed in the WRHE module equals the total amount of water evaporated in the chamber. Air exiting this module at state point 6 has a dry-bulb temperature of 14° C. and a dewpoint of 14° C. This cool, dry air can then be returned to the chamber.

Water, after passing through the water chiller 26, at state point 8, passes through throttle valve 24 and enters the lumens of the hollow fibers of the WRHE module at reduced pressure, at state point 9, having a temperature of 5° C. The temperature of the chilled water stream with entrained water vapor permeate and its latent heat is 7° C., at state point 7. The water recovered from the air stream can be removed from the WRHE, at state point 10, processed and reused as desired.

It is a particular advantage of the system that only simple temperature measurements and control of the blowers directing air to the membrane-based evaporative coolers are required to control the temperature and humidity environment of the chamber.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A method of controlling the temperature and humidity in a closed chamber having a variable energy and water vapor input comprising the steps:

(a) circulating an air stream in said closed chamber;

(b) humidifying said air stream by evaporating water into the same, thereby creating a humidified air stream;

(c) removing at least a portion of said humidified air stream from said closed chamber;

(d) condensing water vapor in said humidified air stream by directing the same to a condenser, thereby removing sensible and latent heat from said humidified air stream to create a water vapor condensate and a cooled and dehumidified air stream; and (e) returning at least a portion of said cooled and dehumidified air stream to said closed chamber.

2. The method of claim 1 applied to a two-zone closed chamber wherein the dewpoint in a second zone is greater than the dewpoint in a first zone, steps (a) and (b) are conducted in both said first and second zones, the resulting humidified air streams are combined and at least a portion thereof is removed as a single combined humidified air stream from said closed chamber, and steps (c), (d) and (e) are conducted on said single combined humidified air stream.

3. The method of claim 1 or 2 wherein step (b) is conducted by circulating said air stream on one side of a membrane and water on the other said of said membrane.

4. The method of claim 3 wherein said air stream is circulated countercurrent to said water.

5. The method of claim 3 wherein said membrane is a hydrophilic membrane.

6. The method of claim 5 wherein said hydrophilic membrane is nonporous.

7. The method of claim 6 wherein said hydrophilic nonporous membrane comprises at least one hollow fiber selected from the group consisting of cellulose, cellulose esters, and polyacrylonitrile.

8. The method of claim 3 wherein said membrane is a hydrophobic membrane.

9. The method of claim 8 wherein said hydrophobic membrane is microporous.

10. The method of claim 8 wherein said hydrophobic membrane comprises at least one hollow fiber selected from the group consisting of polypropylene, polysulfone, polyvinylidene fluoride, polyethylene, and polytetrafluoroethylene.

11. The method of claim 1 or 2 wherein step (d) is conducted by circulating said humidified air stream on one side of a membrane and chilled water on the other side of said membrane, the temperature of said chilled water being lower than the dewpoint of said humidified air stream.

12. The method of claim 11 wherein said membrane is a hydrophilic membrane.

13. The method of claim 12 wherein said hydrophilic membrane comprises at least one hollow fiber selected from the group consisting of cellulose, cellulose esters, polyacrylonitrile.

14. The method of claim 11 wherein said membrane is a hydrophobic membrane.

15. The method of claim 14 wherein said hydrophobic membrane comprises at least one hollow fiber selected from the group consisting of polypropylene, polyethylene, polysulfone, polyvinylidene and polytetrafluoroethylene.

16. The method of claim 13 or 15 wherein said humidified air stream is circulated on a feed side of said hollow fiber membrane, said chilled water is circulated on a permeate side of said hollow fiber membrane, and the total pressure on the permeate side is less than the total pressure on the feed side.

17. The method of claim 1 or 2 wherein at least a portion of said water vapor condensate from step (d) is returned to said closed chamber.

18. The method of claim 1 or 2 wherein the source of said variable water vapor input is at least one living plant.

19. The method of claim 1 or 2 wherein the source of said variable energy input is radiant heat.

20. The method of claim 17 wherein the source of said radiant heat is a lamp.

* * * * *

UNITED STATES PATENT AND TRADEMARK OFFICE

CERTIFICATE OF CORRECTION

PATENT NO. : 5,218,833

DATED : June 15, 1993

INVENTOR(S) : David D. Newbold

It is certified that error appears in the above-identified patent and that said Letters Patent is hereby corrected as shown below:

Col. 1, line 43: after "3a, 3b, 4a and 4b" insert -- are schematics --

Col. 5, line 38: after "recited," delete "n" and insert -- in --

Signed and Sealed this

First Day of March, 1994

Bruce Lehman

BRUCE LEHMAN

*Commissioner of Patents and Trademarks*

*Attest:*

*Attesting Officer*